US006050794A

United States Patent [19]

Noboru et al.

[11] Patent Number: 6,050,794

[45] Date of Patent: Apr. 18, 2000

[54] COMPRESSOR HAVING A PUMP WITH TWO ADJACENT ROCKING ROTORS

[75] Inventors: Yoshinori Noboru; Yasunori Kiyokawa; Katsuki Tsuchiya; Hideki Wadayama, all of Gunma, Japan

[73] Assignee: Sanyo Electric co., Ltd., Moriguchi, Japan

[21] Appl. No.: 08/861,717

[22] Filed: May 22, 1997

[30] Foreign Application Priority Data

| | | | |
|---|---|---|---|
| May 23, 1996 | [JP] | Japan | 8-128456 |
| May 23, 1996 | [JP] | Japan | 8-128457 |
| Sep. 30, 1996 | [JP] | Japan | 8-259670 |
| Sep. 30, 1996 | [JP] | Japan | 8-259671 |

[51] Int. Cl.[7] ..... F04C 11/00; F04C 29/02

[52] U.S. Cl. ..... 418/55.6; 418/66; 418/88; 418/210

[58] Field of Search ..... 418/55.6, 66, 88, 418/94, 209, 210

[56] References Cited

U.S. PATENT DOCUMENTS

| | | | |
|---|---|---|---|
| 1,628,888 | 5/1927 | Klinge | 418/66 |
| 1,681,392 | 8/1928 | Brouse | 418/66 |
| 1,923,291 | 8/1933 | Zimmerer | 418/66 |
| 2,584,865 | 2/1952 | Gordinier | 418/66 |
| 3,001,482 | 9/1961 | Osborn . | |
| 3,016,834 | 1/1962 | Deska et al. . | |
| 5,375,986 | 12/1994 | Ukai et al. | 418/88 |

FOREIGN PATENT DOCUMENTS

| | | |
|---|---|---|
| 0 574 104 | 6/1999 | European Pat. Off. . |
| 315 246 | 11/1956 | Switzerland . |
| 1 234 889 | 6/1971 | United Kingdom . |

*Primary Examiner*—John J. Vrablik
*Attorney, Agent, or Firm*—Darby & Darby

[57] ABSTRACT

A high-performance compressor is capable of preventing inadequate oil feed even if the compressor tilts or foams and it is also capable of reducing the amount of oil discharged. The compressor has a compression element and an electric element housed in a hermetically sealed vessel, the interior of the hermetically sealed vessel being divided into an oil reservoir chamber and a hermetically sealed chamber. Two oil pumps are mounted on one end of a rotary shaft and oil is sucked into one of the oil pumps from the oil reservoir chamber and fed to the compression element mounted on the other end of the rotary shaft; oil is sucked into the other oil pump from the hermetically sealed chamber and fed to the oil reservoir chamber.

7 Claims, 12 Drawing Sheets

COMPRESSOR HAVING A PUMP WITH TWO ADJACENT ROCKING ROTORS

BACKGROUND OF THE INVENTION

1. Field of the Invention

The present invention relates to a compressor which is used for a refrigerator or an air conditioner and which has an oil pump for lubricating a compression element.

2. Description of Related Art

A conventional vertical-type scroll compressor is configured so that the oil in an oil reservoir 101 located at the bottom of the compressor is supplied to a scroll compression element, which is mounted on one end of a rotary shaft, and bearings via an oil pump 100 mounted on the other end of the rotary shaft as shown in FIG. 14.

When such a compressor is installed horizontally, the interior of the compressor is divided into hermetically sealed chambers 201 and 202 by a partitioner 205, the hermetically sealed chamber 202 serving as an oil reservoir as illustrated in FIG. 15. An oil pump 400 is constituted by two pumps: one pump sends the oil, which gathers at the bottom in the hermetically sealed chamber 201 after lubricating the scroll compression element and bearings, to the hermetically sealed chamber 202 via a pipe 203; and the other pump supplies the oil in the hermetically sealed chamber 202 to the scroll compression element and the bearings via a lubricating bore 414 of a rotary shaft 410.

The oil pump 400 in FIG. 16 is constructed by: a housing 404 which has a cylinder 415, an inlet 402, and an outlet 403; a cover 401 for closing the opening of the cylinder 415 of the housing 404; a housing 407 which has a cylinder 416 and an inlet 409; covers 411 and 412 for closing the opening of the cylinder 416 of the housing 407; a rotor 405 which is rotated in the cylinder 415 by the rotary shaft 410; a rotor 408 which rotates in the cylinder 416; and a partitioner 406 which provides a partition between the cylinder 415 and the cylinder 416.

The pump for sending the oil in the hermetically sealed chamber 201 to the hermetically sealed chamber 202 via the pipe 203, and the pump for supplying the oil in the hermetically sealed chamber 202 to the scroll compression element and the bearings via the lubricating bore 414 of the rotary shaft 410 are configured as described above.

If the compressor has a hermetically sealed vessel filled with low pressure gas, then the inlet of the hermetically sealed chamber for reserving oil or the inlet of the oil pump is provided at the bottom of the hermetically sealed vessel.

If the compressor has a hermetically sealed vessel filled with high pressure gas, then the inlet of the oil pump is provided in the hermetically sealed chamber, which has lower pressure, of the hermetically sealed vessel because the oil gathers in a place in the vessel where the pressure is lower.

In the case of the horizontal-type scroll compressor having the conventional structure described above, if the hermetically sealed vessel thereof is filled with the low pressure gas, then the oil spreads all over the internal surface of the hermetically sealed vessel. This has been posing a problem in that, if the compressor tilts or foams, then insufficient lubrication is apt to occur and more oil is undesirably discharged.

If the hermetically sealed vessel of the compressor is filled with high pressure gas, then the area of lower pressure is located near the discharge pipe which provides the outlet of the discharged gas of the compressor. Hence, the oil tends to be discharged together with the discharged gas, posing a problem of an increased amount of discharged oil.

Further, the horizontal-type scroll compressor requires two pumps, one for sending the oil from the hermetically sealed chamber 201 to the hermetically sealed chamber 202, and the other for feeding the oil from the hermetically sealed chamber 202 to the scroll compression element and the bearings as described above.

For this reason, the number of components is doubled, including the cylinders 404, 407, the rotors 405, 408, and the covers 401, 406, 411, 412, resulting in higher cost.

SUMMARY OF THE INVENTION

An object of the present invention is to provide a high-performance compressor which is capable of preventing insufficient lubrication even if the compressor tilts or foams and which is also capable of reducing the discharge amount of oil when the compressor has a hermetically sealed vessel filled with low pressure gas.

It is another object of the present invention to provide a compressor which is capable of effectively reducing the amount of oil discharged even when the compressor has a hermetically sealed vessel filled with high pressure gas.

It is still another object of the present invention to provide a compressor equipped with an oil feeding pump and a lubricating pump to permit two-system oil feeding without adding to the number of components.

To these ends, according to the present invention, there is provided a compressor which has a compression element and an electric element housed in a hermetically sealed vessel, wherein the hermetically sealed vessel is divided into an oil reservoir chamber and a hermetically sealed chamber by a partitioning member, the two oil pumps are mounted on one end of a rotary shaft, oil is sucked into one oil pump from the oil reservoir chamber to feed the oil to the compression element mounted on the other end of the rotary shaft, and the oil is sucked into the other oil pump from the hermetically sealed chamber to feed it to the oil reservoir chamber.

When the compressor is of the low internal pressure type, the oil feed passage for supplying the oil from the hermetically sealed chamber to the oil pump is opened below the gas inlet of the compression element.

When the compressor is of the high internal pressure type, the oil feed passage for supplying the oil from the hermetically sealed chamber to the oil pump is opened below the gas outlet of the compression element.

The oil feeding capability of the oil pump for supplying the oil from the hermetically sealed chamber to the oil reservoir chamber is equivalent to or more than that for supplying the oil from the oil reservoir chamber to the compression element.

The oil feed passage for sucking the oil into the oil pump from the hermetically sealed chamber is composed of a pipe which extends from the bottom of the hermetically sealed chamber out to the oil pump.

In a preferred from, a single oil pump provides two oil feeding systems and it is comprised of: a housing which has a first slot, a first inlet, a first outlet, a second slot, a second inlet, and a second outlet; a first rotor which is housed in a first cylinder of the housing, which rocks in the first cylinder with a first key thereof engaged in the first slot, and which closes the opening of a second cylinder of the housing; a second rotor which is housed in the second cylinder of the housing and which rocks in the second cylinder with a second key thereof engaged in the second slot; and a cover which closes the opening of the first cylinder of the housing; wherein the first rotor and the second rotor are rocked by the rotary shaft.

In another preferred form, a single oil pump provides two oil feeding systems and it is comprised of: a housing which has an elliptical cylinder, a first inlet, a first outlet, a second inlet, and a second outlet; a rotor which is housed in the elliptical cylinder of the housing and which has two slots on the outer periphery thereof, the slots being opposed 180 degrees to each other; and a partitioning rotor which is engaged in the two slots of the foregoing rotor and which slidably moves in the cylinder.

DESCRIPTION OF THE PREFERRED EMBODIMENTS

Figure 1:
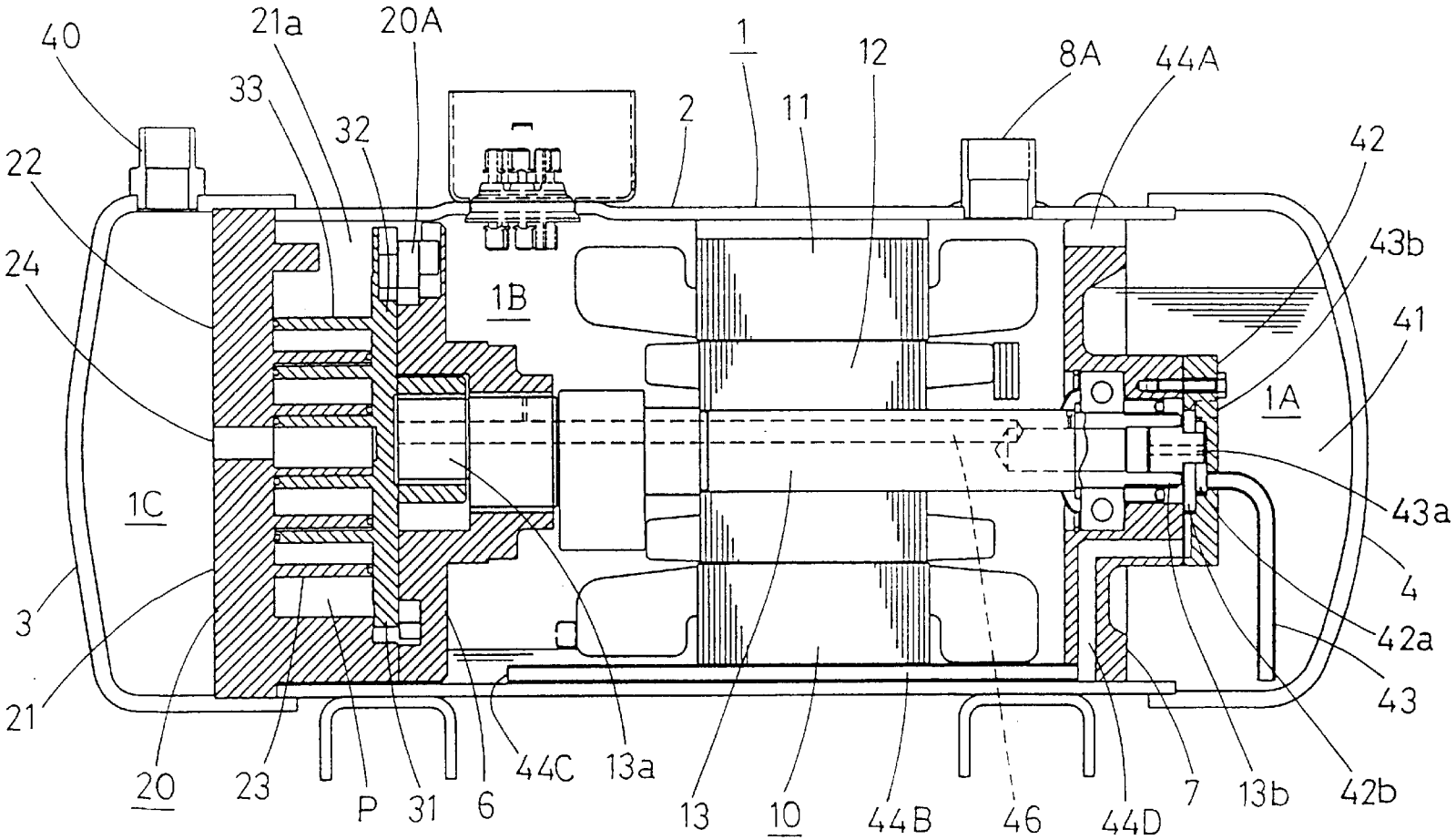
FIG. 1 is a vertical sectional view illustrating the entire configuration of a horizontal-type scroll compressor of an embodiment according to the present invention.

The present invention will now be described in detail with reference to the accompanying drawings. FIG. 1 shows the entire configuration of a horizontal-type scroll compressor of an embodiment in accordance with the present invention.

A hermetically sealed vessel 1 is constructed by a cylindrical case 2, and top and bottom end caps 3 and 4 attached respectively to the left and right ends of the case 2. A main frame 6 serving as a main bearing is hermetically secured to the left end of the cylindrical case 2 by shrink fitting or press fitting; and a journal member 7 serving as a subsidiary bearing is hermetically secured to the right end of the cylindrical case 2 by shrink fitting or press fitting. A first hermetically sealed chamber 1A functioning as an oil reservoir chamber is formed between the journal member 7 and the end cap 4; and a second hermetically sealed chamber 1B is formed between the journal member 7 and the end cap 3.

An electric element 10 is provided between the main frame 6 and the journal member 7 in the second hermetically sealed chamber 1B; and a scroll compression element 20, which is driven by the electric element 10, is provided between the main frame 6 and the end cap 3.

The electric element 10 is composed of a stator 11, a rotor 12 which is rotatably inserted in the stator 11, and a rotary shaft 13 which forms the central shaft of the rotor 12; a left end section 13*a* and a right end section 13*b* of the rotary shaft 13 are rotatably journaled by the main frame 6 and the journal member 7 via bearing members.

The scroll compression element 20 is constituted by a fixed scroll 21 and a rocking scroll 31 which are laterally opposed to each other. Involute teeth 23 formed on an end plate 22 of the fixed scroll 21 are engaged with involute teeth 33 formed on an end plate 32 of the rocking scroll 31 to form a compression chamber P wherein a plurality of compression spaces are gradually narrowed from outside toward inside.

The rocking scroll 31 is interlocked with the eccentric end section 13*a* of the rotary shaft 13 and it is eccentrically and rotatably journaled on the main frame 6. The rocking scroll 31 is revolved by an Oldham's coupling 20A in relation to the fixed scroll 21 so that it does not rotate, thus providing an eccentric motion. This causes a low pressure refrigerant gas, which is directly introduced through an inlet 8A communicated with the second hermetically sealed chamber 1B from outside, to pass through an introducing passage, which will be discussed later, and reach the compression chamber P where it is compressed. The compressed high pressure refrigerant gas is discharged through a discharge port 24 provided at the center of the fixed scroll 21.

Provided on the discharge side surface of the discharge port 24 of the fixed scroll 21 in the scroll compression element 20 is a discharge chamber 1C isolated from the second hermetically sealed chamber 1B. The high pressure refrigerant gas discharged from the discharge port 24 is released from an outlet 40 via the discharge chamber 1C.

An internal bottom space of the first hermetically sealed chamber 1A which is formed by the case 2 and the end cap 4 serves as an oil reservoir 41.

The oil collected in the oil reservoir 41 is sucked in through an intake pipe 43 of an oil pump 42*a* out of two oil pumps 42*a* and 42*b* which make up an oil pump 42 provided on the journal of the journal member 7 supporting the eccentric section 13*b* on the other end of the rotary shaft 13 of the electric element 10, and it is supplied to respective bearing sliding sections via an outlet 43*a*.

The oil in the hermetically sealed chamber 1B is sucked in by the other oil pump 42*b* through an opening 44C of a communicating pipe 44B (oil feeding passage) which is located at the bottom side of the case 2 forming the hermetically sealed chamber 1B and which is located below an intake chamber 21*a* provided on the fixed scroll 21 of the scroll compression element 20; and the oil passes through a passage 44D provided on the journal member 7 before it is discharged into the oil reservoir 41 through an outlet 43*b* of the oil pump 42*b*.

The journal member 7, which also serves as the partitioner between the oil reservoir 41 and the hermetically sealed chamber 1B, is provided with an opening 44A to prevent a difference in pressure between the oil reservoir 41 and the hermetically sealed chamber 1B. The low pressure refrigerant gas directly introduced through the inlet 8A into the second hermetically sealed chamber 1B passes through the inlet chamber 21*a* provided on the fixed scroll 21 of the scroll compression element 20 and goes into the compression chamber P. The low pressure refrigerant gas which has been thus introduced is compressed in the compression chamber P, and the compressed high pressure refrigerant gas is released into the discharge chamber 1C through the discharge port 24 provided in the fixed scroll 21, then it is let out of the hermetically sealed vessel 1 through the outlet 40 provided in the discharge chamber 1C.

More specifically, while the aforesaid low pressure refrigerant gas moves from the inlet 8A to the inlet chamber 21*a* of the fixed scroll 21, the oil contained in the refrigerant is separated and dropped to the bottom of the case 2. The oil is sucked by the oil pump 42*b* through the opening 44C of the pipe 44B and fed to the oil reservoir 41 through the outlet 43*b* of the oil pump 42*b*, then the oil gathered in the oil reservoir 41 is fed by the oil pump 42*a* through the oil feeding pipe 43 to the bearing sliding sections via the outlet 43*a* of the oil pump 42*a* and an oil feeding bore 46.

The level of the oil collected at the bottom in the second hermetically sealed chamber 1B is lower than the level of the oil collected in the oil reservoir 41 at the bottom in the first hermetically sealed chamber 1A. This prevents the oil from being stirred by the rotor 12 of the electric element 10 housed in the second hermetically sealed chamber 1B so as to ensure smooth oil feeding by the oil pump 42; it also prevents the deterioration in compression efficiency attributable to an input loss or an increase in oil discharge caused by the oil being stirred by the rotor 12 of the electric element 10.

Thus, the first hermetically sealed chamber 1A, which is the oil reservoir, and the second hermetically sealed chamber 1B are divided by the journal member 7, which also serves as the partitioner, in the hermetically sealed vessel 1, and the oil is fed from the hermetically sealed chamber 1B to the hermetically sealed chamber 1A.

Hence, a high-performance compressor capable of reducing the amount of discharged oil can be achieved. When the hermetically sealed vessel 1 of the compressor is filled with low pressure gas, even if the compressor tilts or foams, inadequate oil supply will not happen, thus ensuring sufficient oil to be fed from the first hermetically sealed chamber 1A to the respective sections to be lubricated.

Further, the communicating pipe 44B which is the oil passage for supplying oil from the second hermetically sealed chamber 1B to the oil pump 42 has an opening 44C below the gas inlet chamber 21*a* of the compression element 20, therefore, the oil can be sucked up from the low pressure area where the oil tends to gather. This allows effective use of all the oil in the second hermetically sealed chamber 1B.

The capability of supplying oil from the second hermetically sealed chamber 1B to the oil pump 42 is set so that it is equivalent to or more than the capability of supplying oil from the first hermetically sealed chamber 1A, i.e. the oil reservoir, to the oil pump 42. This allows effective use of all the oil in the hermetically sealed vessel 1.

The first hermetically sealed chamber 1A, i.e. the oil reservoir, is defined by the journal member 7 which is an existing component. Hence, the number of the components can be reduced.

In addition, a part of the passage which communicates the second hermetically sealed chamber 1B with the oil pump 42 is formed in the journal member 7, thus obviating the need for connecting the pipes with a resultant decreased number of components.

Figure 2:
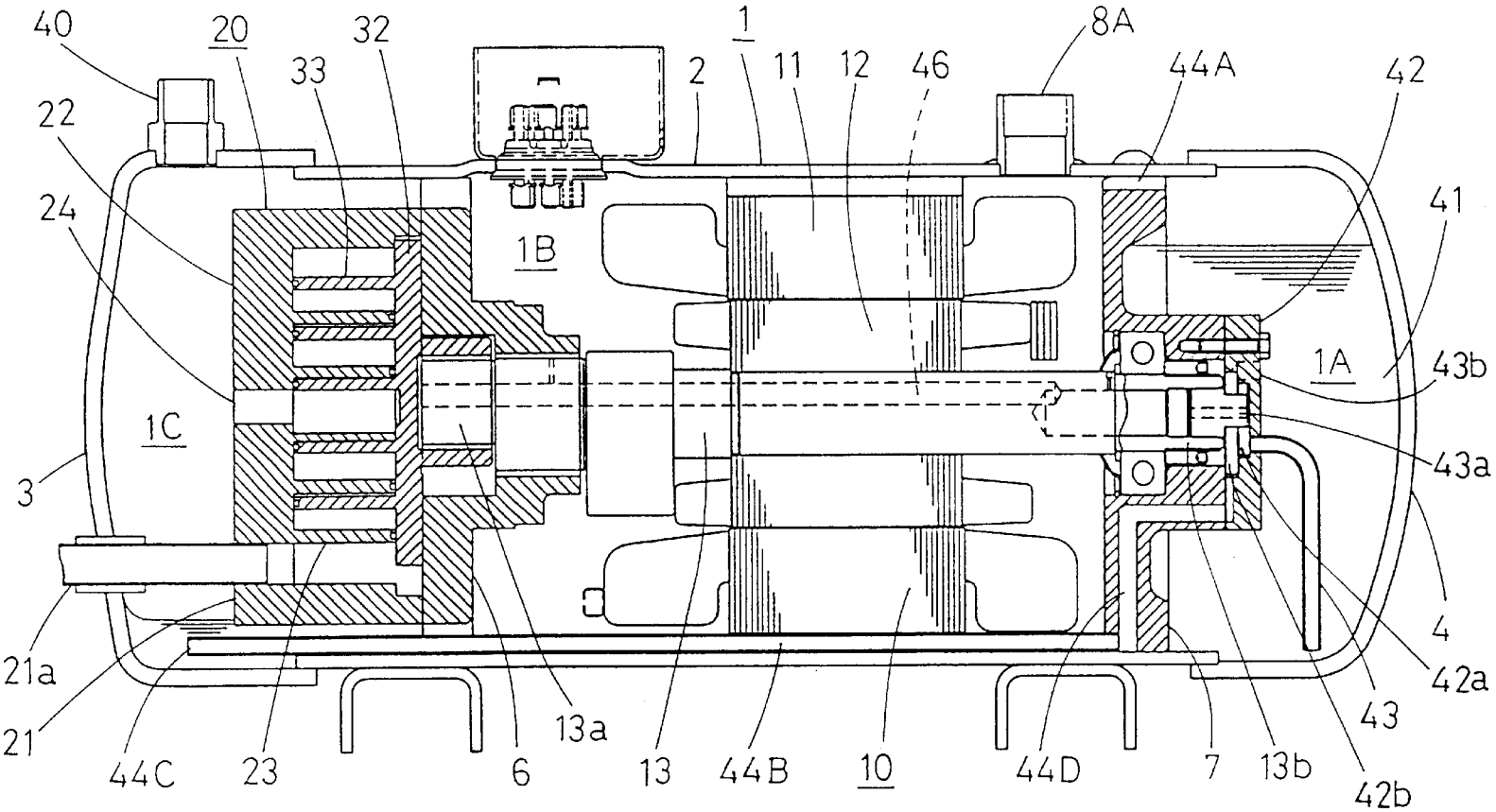
FIG. 2 is a vertical sectional view illustrating the entire configuration of a horizontal-type scroll compressor according to another embodiment.

FIG. 2 shows another embodiment. The horizontal-type compressor in this embodiment has the compression element 20 and the electric element 10 enclosed in the hermetically sealed vessel 1 filled with high pressure gas; it is designed to supply oil to the compression element 20 mounted on one end 13*a* of the rotary shaft 13 via a two-circuit oil pump 42 mounted on the other end of the rotary shaft 13.

In the hermetically sealed vessel 1, the first hermetically sealed chamber 1A, which functions as the oil reservoir, and the second hermetically sealed chamber 1B are defined by the main frame 6 and the journal member 7 which also functions as the partitioner; and oil is fed by the oil pump 42*a* from the first hermetically sealed chamber 1A to the respective sections to be lubricated. The communicating pipe 44B, i.e. the oil feeding passage, for supplying oil from the second hermetically sealed chamber 1B to the first hermetically sealed chamber 1A, i.e. the oil reservoir chamber, by the oil pump 42*b* has the opening 44C located in the discharge chamber 1C below the gas outlet 40.

Thus, in the case of the compressor having the hermetically sealed vessel 1 filled with high pressure gas, the opening 44C of the communicating pipe 44B, i.e. the oil feeding passage, is disposed below the gas outlet 40 of the compressor where the pressure is low, that is, the area where most oil gathers in the discharge chamber 1C; therefore, the oil is not discharged together with the gas when the gas is discharged. This makes it possible to reduce the amount of discharged oil and to effectively use the oil in the discharge chamber 1C without wasting it.

Figure 3:
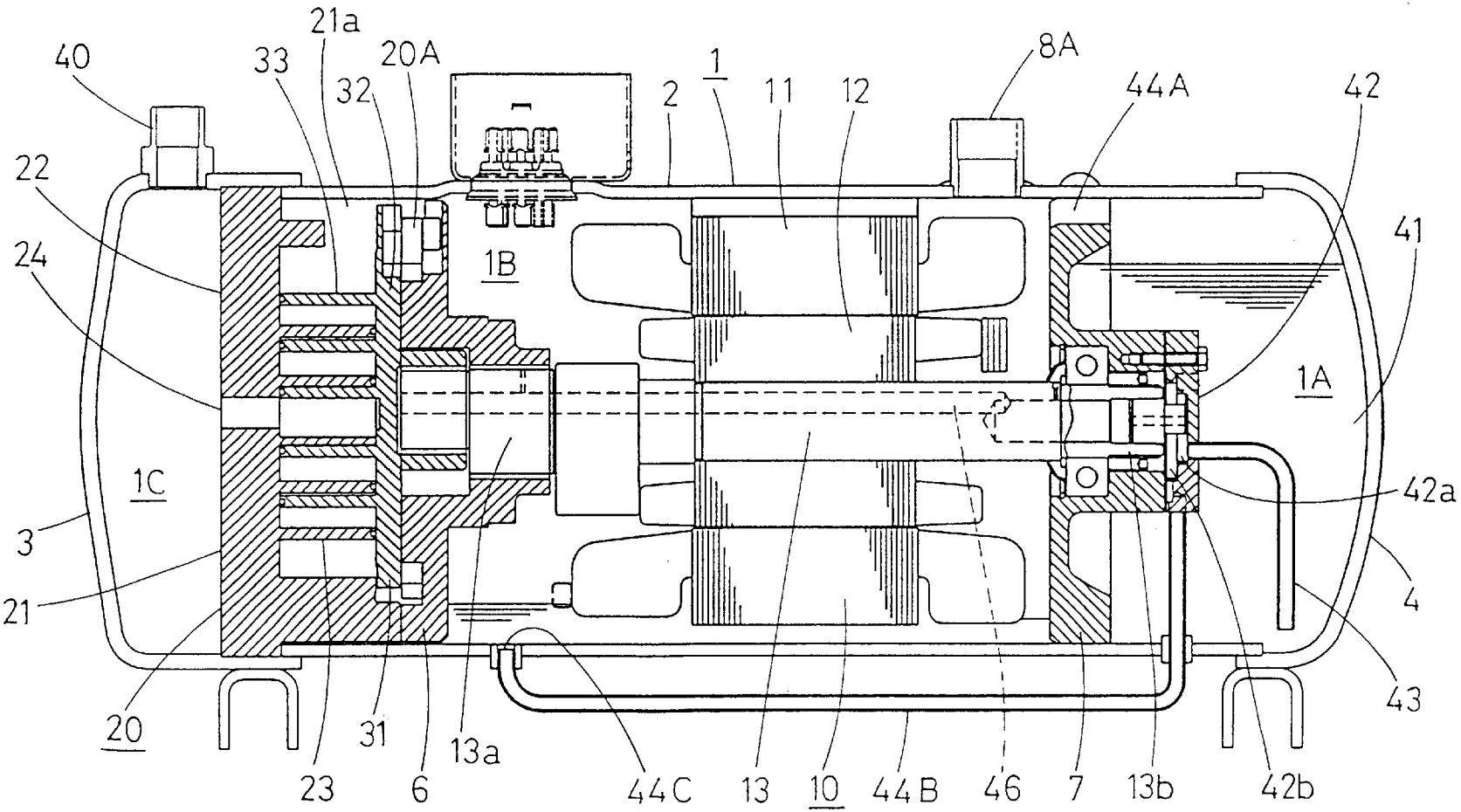
FIG. 3 is a vertical sectional view illustrating the entire configuration of a horizontal-type scroll compressor according to still another embodiment.

FIG. 3 shows still another embodiment. The horizontal-type compressor in this embodiment has the compression element 20 and the electric element 10 enclosed in the hermetically sealed vessel 1; it is designed to supply oil to the compression element 20 mounted on one end 13*a* of the rotary shaft 13 via the oil pump 42 mounted on the other end of the rotary shaft 13.

In the hermetically sealed vessel 1, the first hermetically sealed chamber 1A, i.e. the oil reservoir chamber, and the second hermetically sealed chamber 1B are defined by the main frame 6 and the journal member 7 which function as the partitioners; and oil is fed by the oil pump 42*a* from the first hermetically sealed chamber 1A to the respective sections to be lubricated. The oil feeding passage for supplying oil by the oil pump 42*b* from the second hermetically sealed chamber 1B to the first hermetically sealed chamber 1A is constituted by the communicating pipe 44B which extends from the bottom of the second hermetically sealed chamber 1B out of the hermetically sealed vessel 1 and reaches the oil pump 42*b* via the first hermetically sealed chamber 1A, i.e. the oil reservoir chamber. Reference numeral 44C denotes the opening of the communicating pipe 44B.

In the case of this embodiment, the communicating pipe 44B is disposed outside the hermetically sealed vessel 1; therefore, even when various obstacles including the stator 11 are present between the hermetically sealed chamber 1B and the oil pump 42, no problem should arise. This makes it possible to simplify the interior of the hermetically sealed vessel 1 and also to facilitate the piping work.

Thus, according to the present invention, when the hermetically sealed vessel of the compressor is filled with low pressure gas, even if the compressor tilts or foams, inadequate oil supply will not happen. Thus, a high-performance compressor capable of reducing the amount of discharged oil can be achieved.

Moreover, even when the hermetically sealed vessel is filled with high pressure gas, since the opening of the oil feeding passage is disposed below the gas outlet of the compressor where the pressure is low, the oil is not discharged together with the gas when the gas is discharged. This allows a reduced amount of discharged oil.

In addition, since the oil feeding passage is disposed outside the hermetically sealed vessel, even when various obstacles including the stator are present between the hermetically sealed chamber and the oil pump, no problem should arise. This makes it possible to simplify the interior of the hermetically sealed vessel and also to facilitate the piping work.

Figure 4:
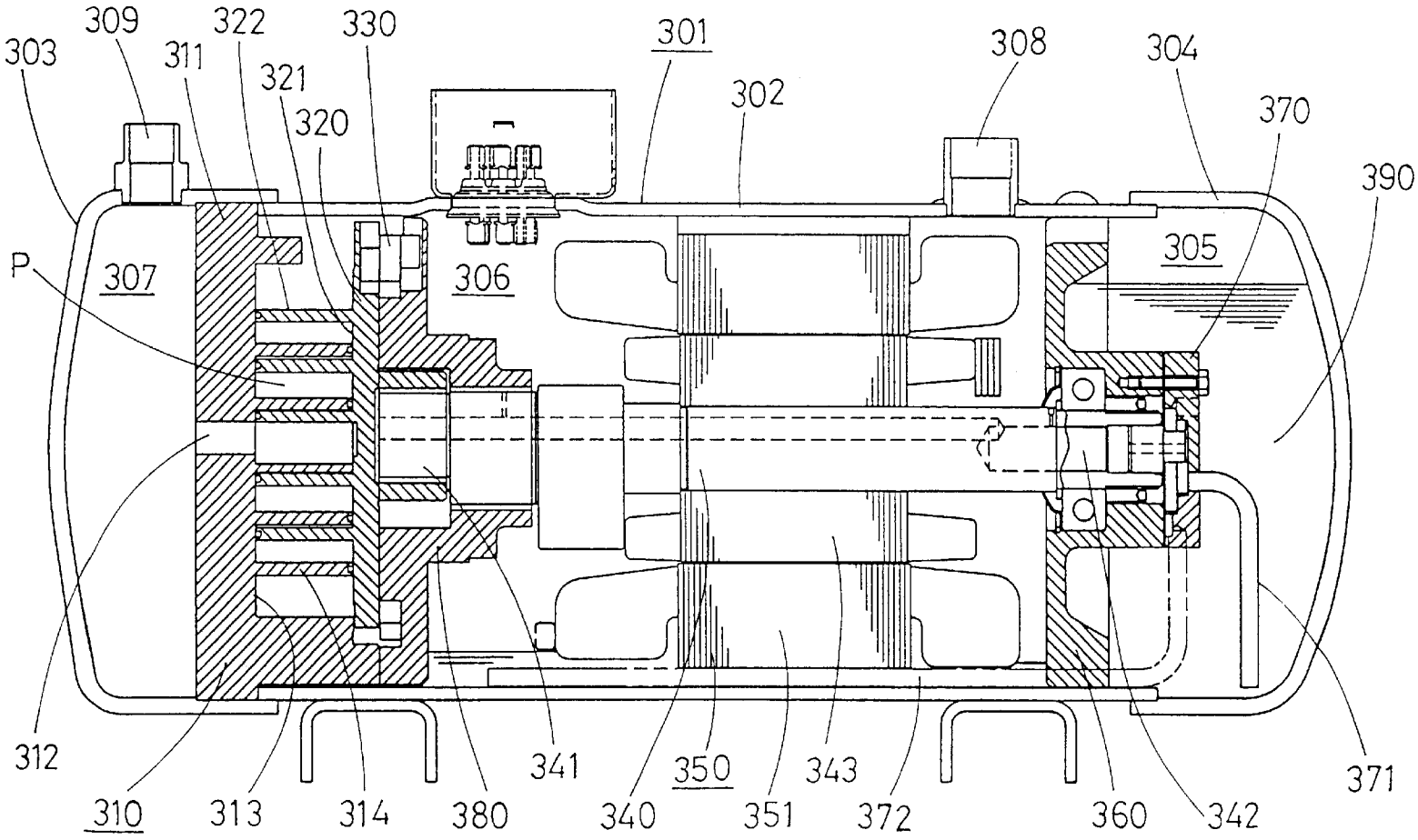
FIG. 4 is a vertical sectional view illustrating the entire configuration of a horizontal-type scroll compressor according to a further embodiment.

FIG. 4 shows the entire configuration of yet another compressor in accordance with the present invention. In this embodiment also, a hermetically sealed vessel 301 is constructed by a cylindrical case 302, an end cap 303 attached to the left end of the case 302, and a bottom 304 attached to the right end of the case 302. A fixed scroll 311 is hermetically attached to the left end of the case 302, and a journal member 360 serving as a subsidiary bearing member is hermetically attached to the right end thereof. A second hermetically sealed chamber 306 is formed between the fixed scroll 311 and the journal member 360.

An electric element 350 is provided between a main frame 380 serving as the main journal member in the second hermetically sealed chamber 306 and the journal member 360. A scroll compression element 310 driven by the electric element 350 is provided between the main frame 380 and the end cap 303.

The electric element 350 is composed of a stator 351, a rotor 343 which is rotatably inserted in the stator 351, and a rotary shaft 340 which forms the central shaft of the rotor 343; a left end section 341 and a right end section 342 of the rotary shaft 340 are rotatably journaled by the main frame 380 and the journal member 360 via bearing members.

The scroll compression element 310 is constituted by a fixed scroll 311 and a rocking scroll 320 which are laterally opposed to each other. Involute teeth 314 formed on an end plate 313 of the fixed scroll 311 are engaged with involute teeth 322 formed on an end plate 321 of the rocking scroll 320 to form a compression chamber P wherein a plurality of compression spaces are gradually narrowed from outside toward inside.

The rocking scroll 320 is interlocked with the eccentric end section 341 of the rotary shaft 340 of the electric element 350 and it is eccentrically and rockably journaled on the main frame 380. The rocking scroll 320 is revolved by an Oldham's coupling 330 in relation to the fixed scroll 311 so that it does not rotate, thus providing an eccentric motion. This causes a refrigerant gas to be introduced through an inlet 308, which is communicated with the second hermetically sealed chamber 306, and compressed in the compression chamber P. The compressed high pressure refrigerant gas is discharged through a discharge port 312 provided at the center of the fixed scroll 311.

Provided on the discharge side surface of the discharge port 312 of the fixed scroll 311 in the scroll compression element 310 is a chamber (discharge chamber) 307 isolated from the second hermetically sealed chamber 306. The high pressure refrigerant gas discharged from the discharge port 312 via the chamber 307 is released from an outlet 309.

An internal bottom space of the first hermetically sealed chamber 305, i.e. the oil reservoir chamber, which is formed by the journal member 360 and the bottom 304, serves as an oil reservoir 390.

The oil gathered in the oil reservoir 390 is sucked in through an intake pipe 371 of an oil feeding pump formed in an oil pump 370 provided on the journal of the journal member 360 supporting the eccentric section 342 on the other end of the rotary shaft 340 of the electric element 350, and it is supplied to the scroll compression element and the respective bearing sliding sections.

There is a pipe 372 providing an oil passage at the bottom side of the case 302 constituting the second hermetically sealed chamber 306; the pipe 372 is connected to the inlet of the oil feeding pump formed in the oil pump 370. The outlet of the oil feeding pump is connected to the first hermetically sealed chamber 305. Thus, the oil which gathers at the bottom of the case 302 constituting the hermetically sealed chamber 306 after lubricating the scroll compression element and the respective bearing sliding sections at the end of the rotary shaft in the second hermetically sealed chamber 306 is sent to the oil reservoir of the hermetically sealed chamber 305.

The level of the oil collected at the bottom in the second hermetically sealed chamber 306 becomes lower than the level of the oil collected in the oil reservoir 390 at the bottom in the first hermetically sealed chamber 305. This prevents the oil from being stirred by the rotor 343 of the electric element 350 housed in the second hermetically sealed chamber 306 so as to ensure smooth oil feeding by the oil pump 370; it also prevents the deterioration in compression efficiency attributable to an input loss or an increase in oil discharge caused by the oil being stirred by the rotor 343 of the electric element 350.

Figure 9:
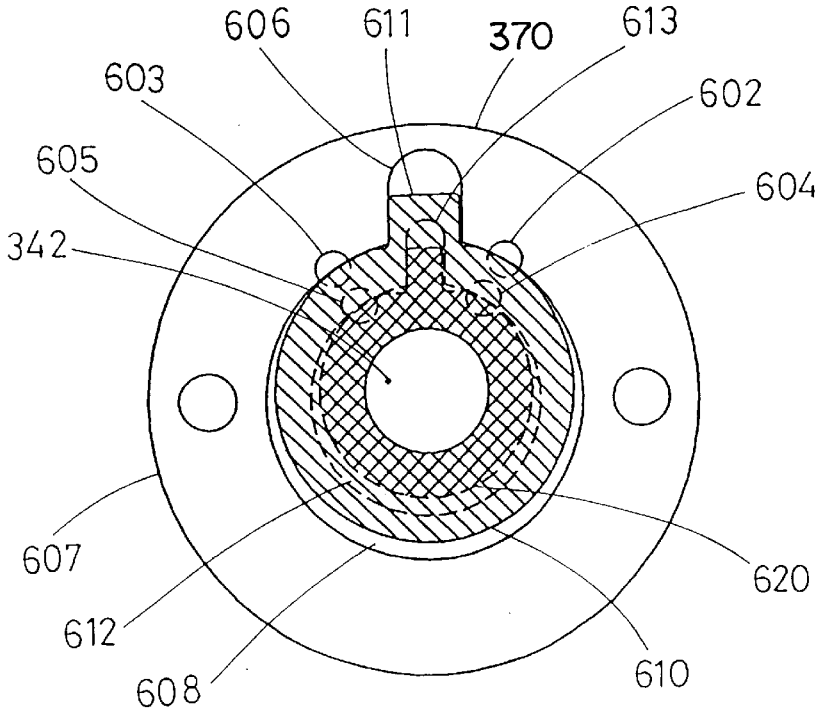
FIG. 9 is a top sectional view illustrating another oil pump of the compressor shown in FIG. 4 when a discharging stroke of the oil pump has been completed.
Figure 10:
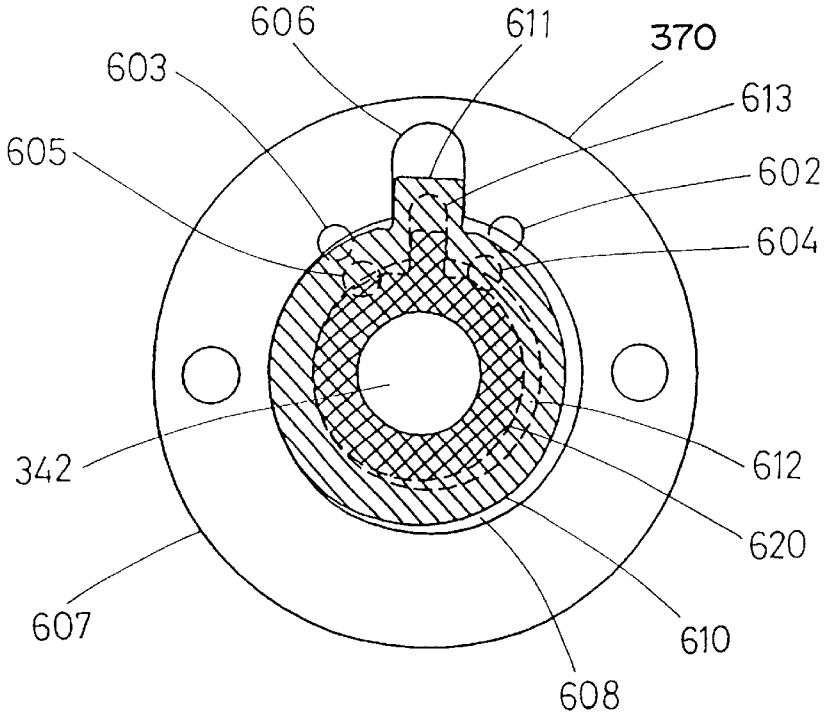
FIG. 10 is a top sectional view illustrating the oil pump shown in FIG. 9 when the oil pump is starting an intake stroke.
Figure 11:
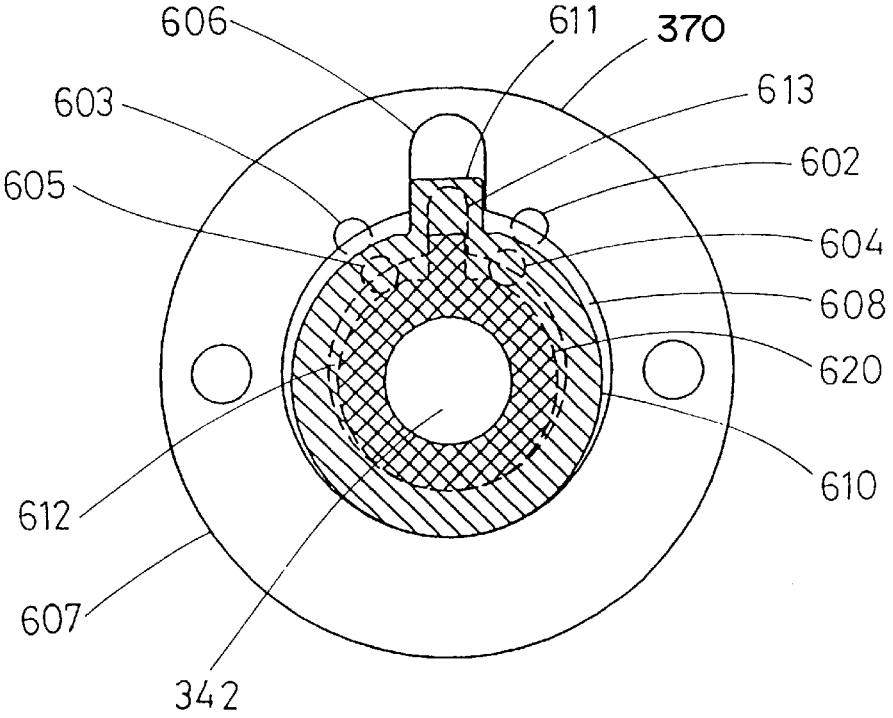
FIG. 11 is a top sectional view illustrating the oil pump shown in FIG. 9 when the oil pump is in the middle of a compression stroke.
Figure 12:
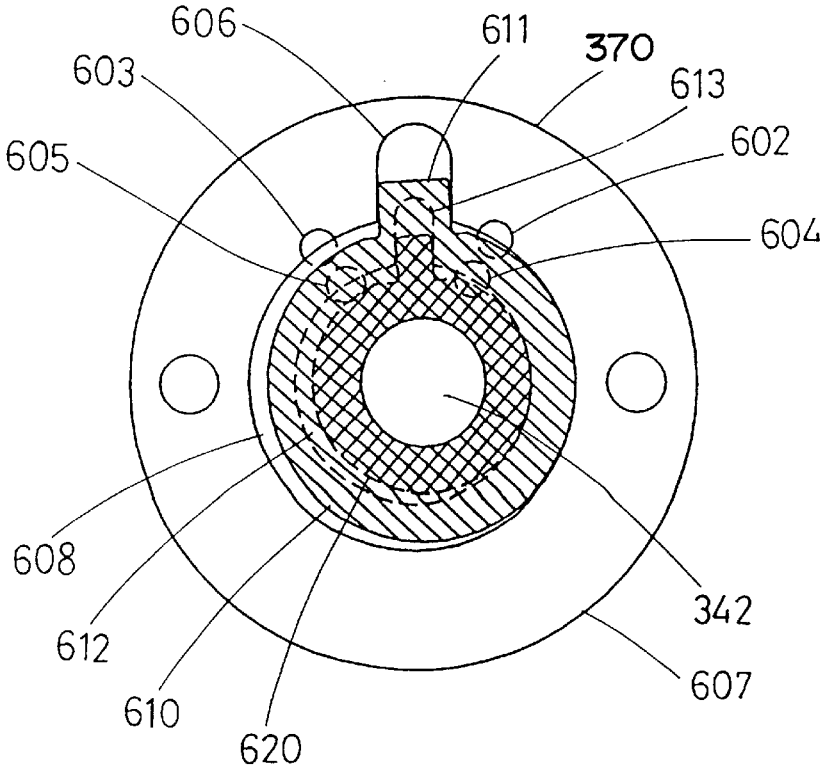
FIG. 12 is a top sectional view illustrating the oil pump shown in FIG. 9 when the oil pump is in a discharging stroke.
Figure 13:
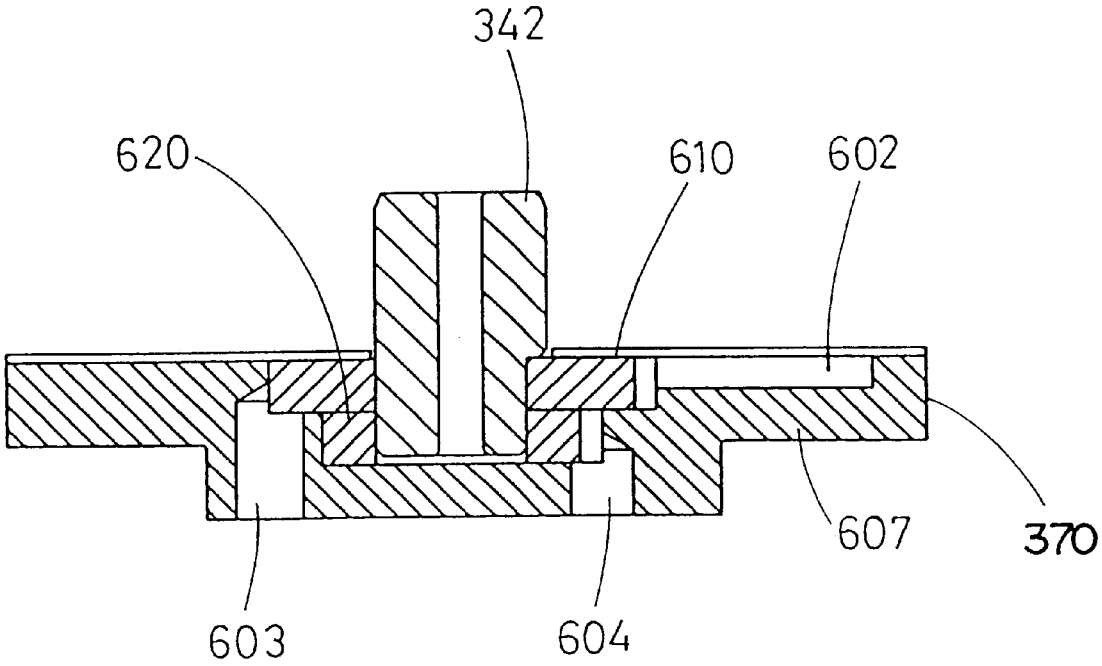
FIG. 13 is a sectional view of the oil pump shown in FIG. 9.
Figure 14:
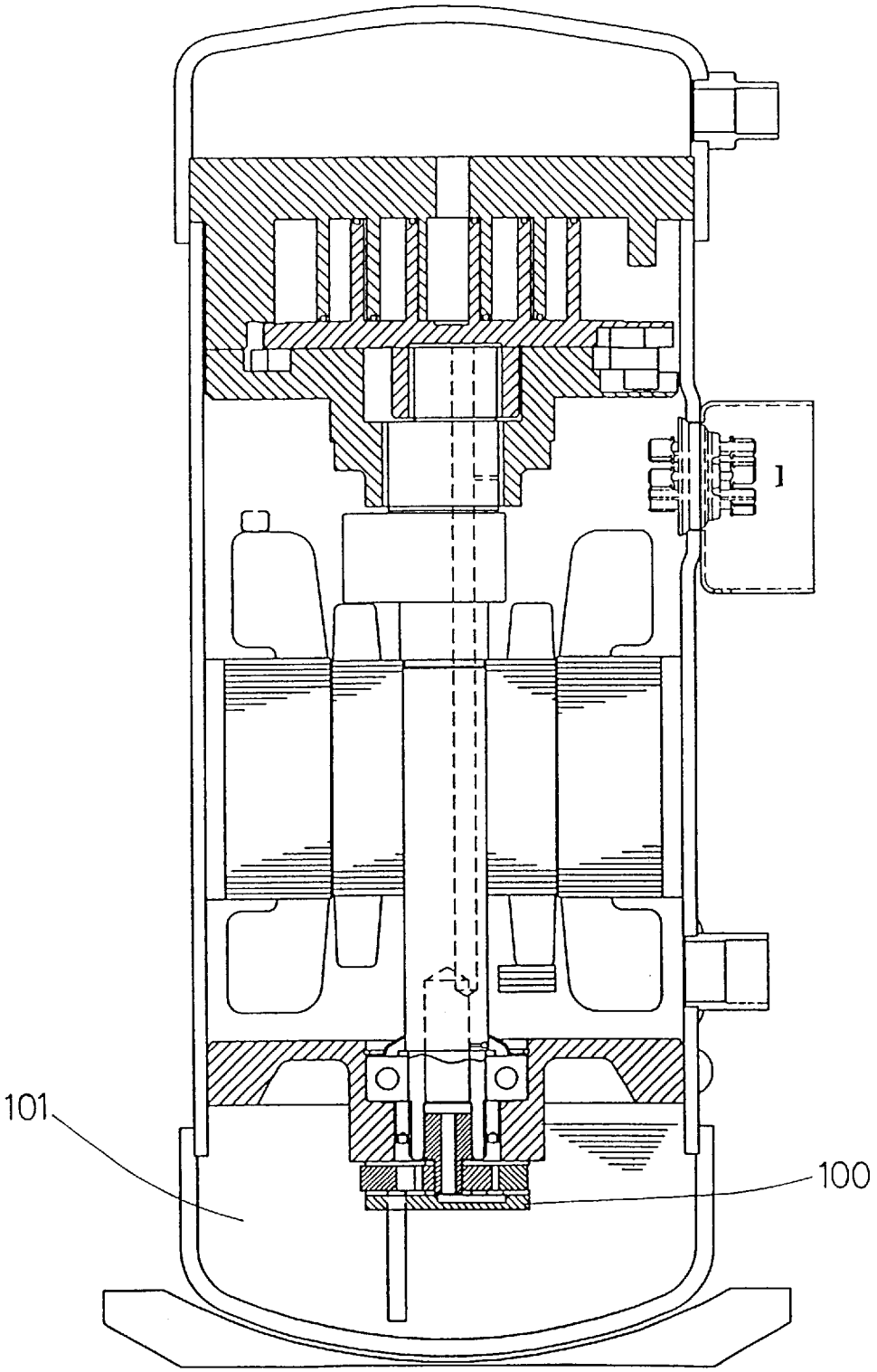
FIG. 14 PRIOR ART
FIG. 14 is a sectional view showing the entire configuration of a conventional vertical-type scroll compressor.
Figure 15:
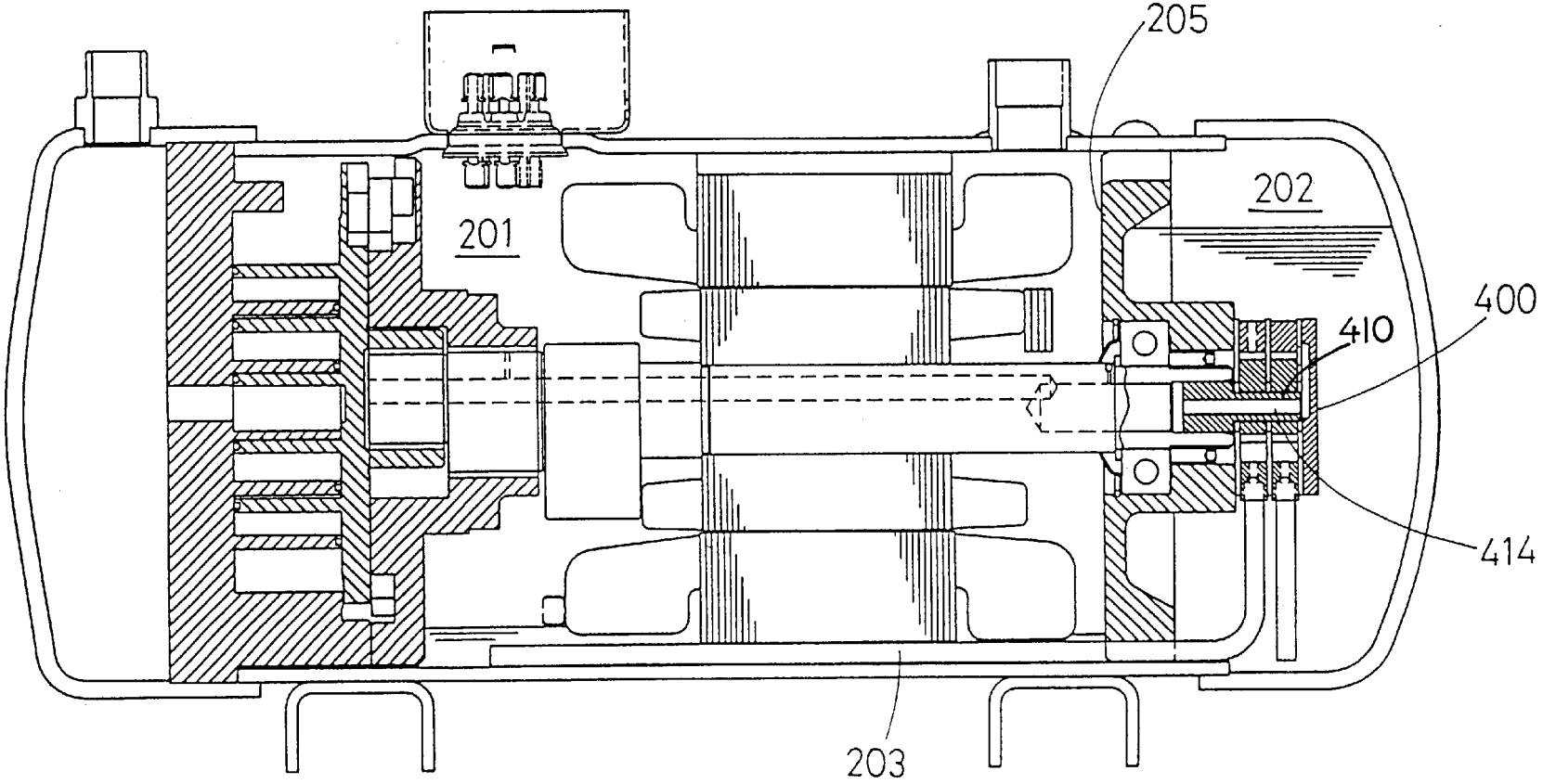
FIG. 15 PRIOR ART
FIG. 15 is a sectional view showing the entire configuration of a conventional horizontal-type scroll compressor.
Figure 16:
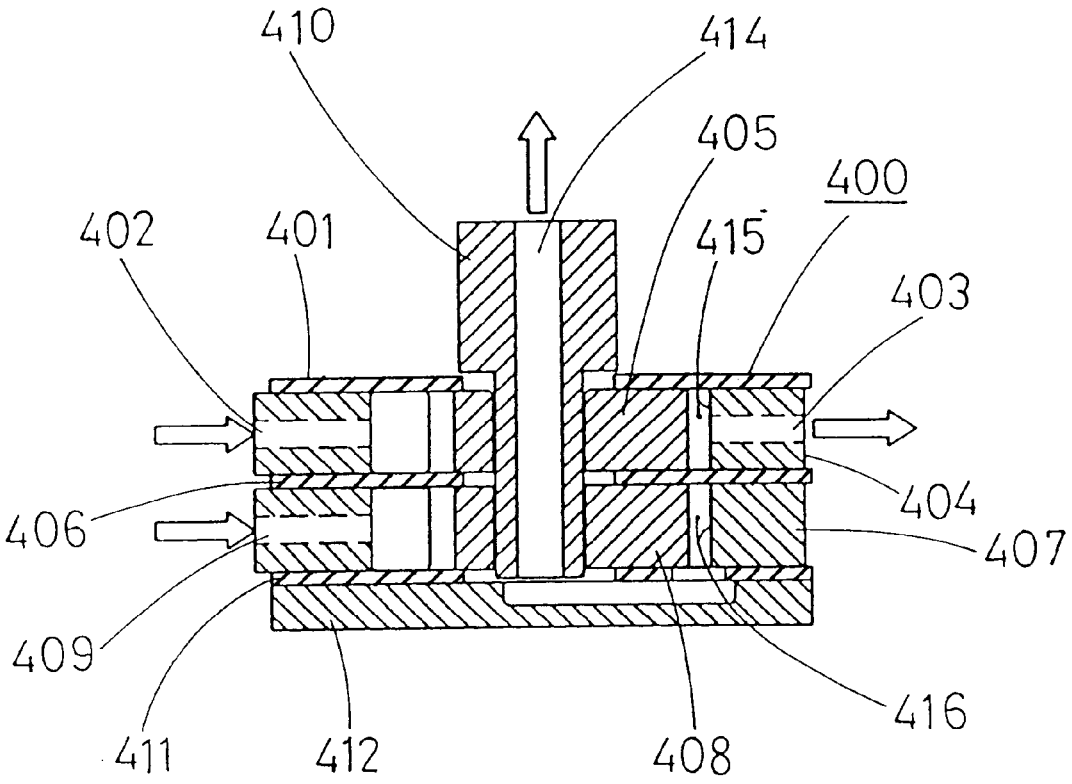
FIG. 16 PRIOR ART
FIG. 16 is a sectional view showing a conventional oil pump.

As shown in FIG. 9, the oil pump 370 which has the function of oil feeding pump and oil sending pump is constituted by: a housing 607 which has a first slot 606, a first inlet 602, a first outlet 603, a second slot 613, a second inlet 604, and a second outlet 605; a first rotor 610 which is housed in a first cylinder 608 of the housing 607, which rocks in the first cylinder 608 with a first key 611 thereof engaged in the first slot 606, and which closes the opening of a second cylinder 612 of the housing 607; a second rotor 620 which is housed in the second cylinder 612 of the housing 607 and which rocks in the second cylinder 612 with a second key 621 thereof engaged in the second slot 613; and a cover which closes the opening of the first cylinder 608 of the housing 607; wherein the first rotor 610 and the second rotor 620 are rocked by the eccentric section 342 of the rotary shaft.

In the oil pump 370 configured as described above, as the eccentric section 342 of the rotary shaft 340 turns, the first and second rotors 610 and 620 rock in the first and second cylinders 608 and 612, respectively, as shown in FIG. 9 through FIG. 12 to suck in oil through the first inlet 602 and the second inlet 604 separately, then the compressed oil is discharged through the first outlet 603 and the second outlet 605 separately.

As described above, the oil pump 370 has the two cylinders 608 and 612, and the two rotors 610 and 620, thus enabling two oil feeding systems. Moreover, the first rotor 610 also serves to close the cylinder 612 for the second rotor 620, eliminating the need for the partitioner provided between the cylinders. Thus, only one housing is required, reducing the number of the components.

Figure 5:
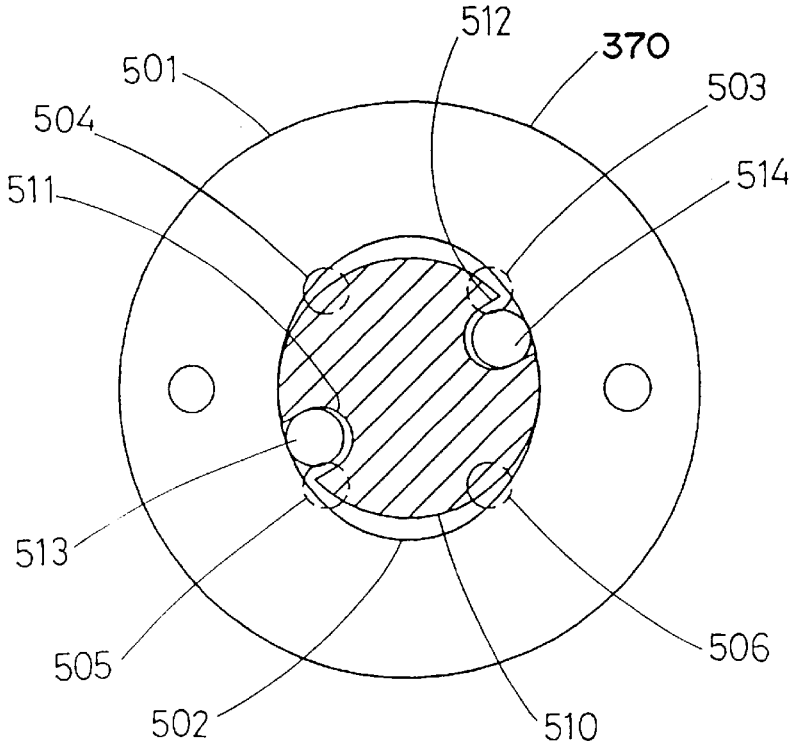
FIG. 5 is a top sectional view illustrating an oil pump of the compressor shown in FIG. 4 when a discharging stroke of the oil pump has been completed.
Figure 6:
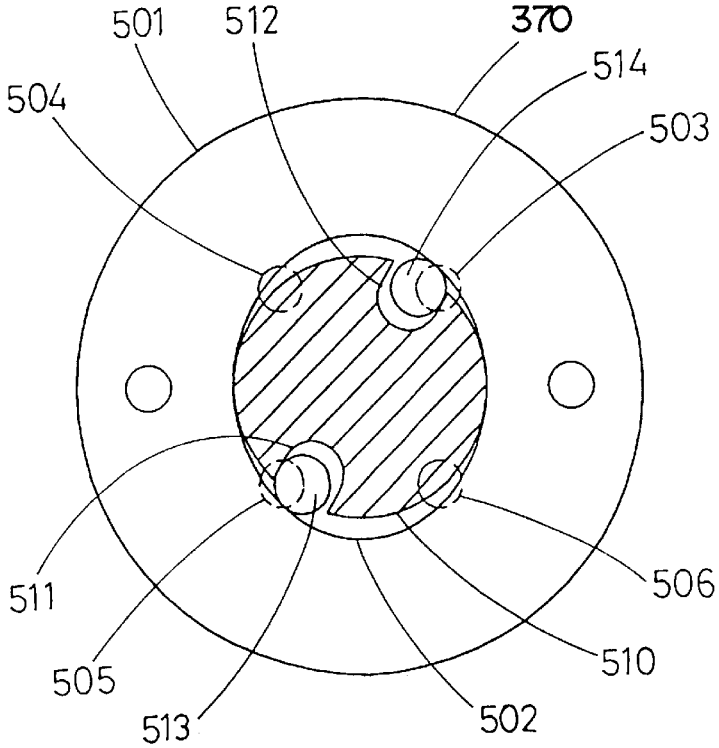
FIG. 6 is a top sectional view illustrating the oil pump shown in FIG. 5 when the oil pump is starting an intake stroke.
Figure 7:
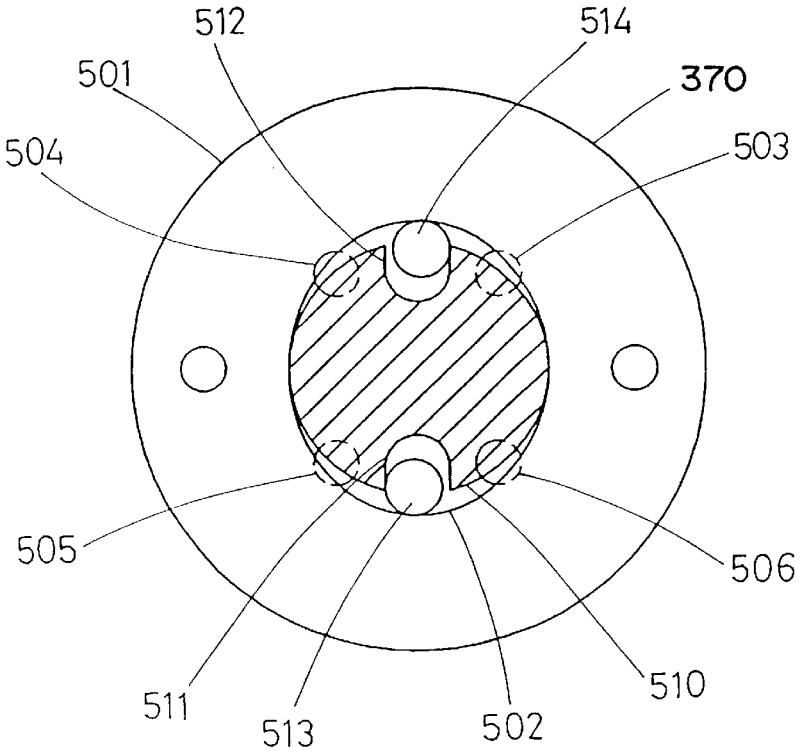
FIG. 7 is a top sectional view illustrating the oil pump shown in FIG. 5 when the oil pump is in the middle of a compression stroke.
Figure 8:
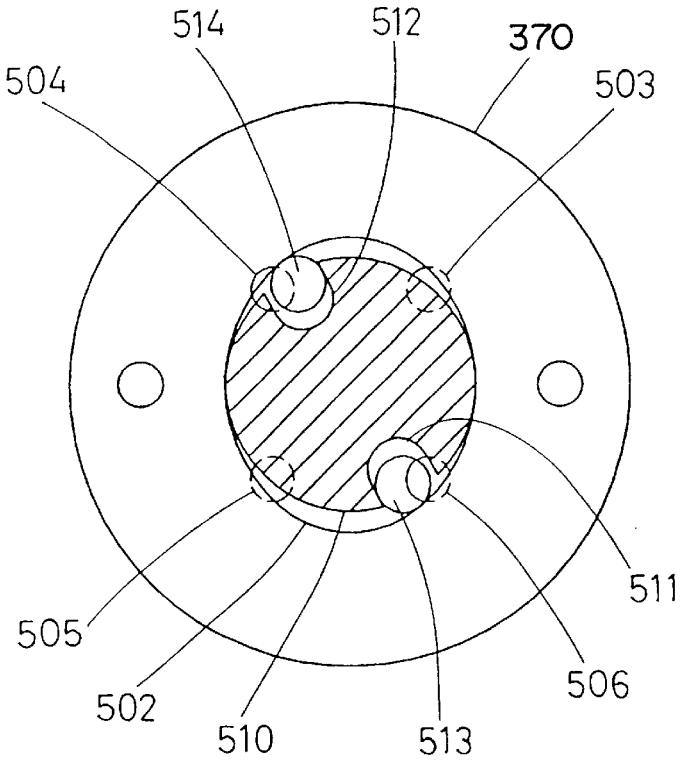
FIG. 8 is a top sectional view illustrating the oil pump shown in FIG. 5 when the oil pump is in a discharging stroke.

FIG. 5 illustrates another configuration of the oil pump 370. The oil pump 370 in this embodiment is composed of: a housing 501 which has an elliptical cylinder 502, a first inlet 503, a first outlet 504, a second inlet 505, and a second outlet 506; a rotor 510 which is housed in the elliptical cylinder 502 of the housing 501 and which has two slots 511 and 512 on the outer periphery thereof, the slots being opposed 180 degrees to each other; and partitioning rotors 513 and 514 which are engaged in two slots 511 and 512 of the rotor 510 and which slidably move in the cylinder 502.

The configuration of the oil pump 370 described above enables the single cylinder 502 and the single rotor 510 to provide the two oil feeding systems, thus achieving fewer components.

As is obvious from the description above, according to the configuration illustrated in FIG. 9, since the oil pump has two cylinders and two rotors, two-system oil feeding can be achieved. In addition, the partitioner between the cylinders is no longer necessary since the first rotor also functions to close the second cylinder for the second rotor. As a result, only one housing is required and the number of components can be decreased.

Hence, it is possible to provide an inexpensive scroll compressor with high lubricating performance which permits the two-system oil feeding without adding to the number of components.

The configuration shown in FIG. 5 enables the two-system oil feeding by using one cylinder and one rotor, also achieving a reduced number of components.

What is claimed is:

1. A compressor configured to supply oil to a scroll compression element and a bearing mounted on one end of a rotary shaft via an oil pump mounted on the other end of the rotary shaft; wherein said oil pump comprises:

a housing which has a first slot, a first inlet, a first outlet, a second slot, a second inlet, and a second outlet;

a first rotor which is housed in a first cylinder of the housing, which rocks in the first cylinder with a first key thereof engaged in said first slot, and which closes the opening of a second cylinder of the housing;

a second rotor which is housed in the second cylinder of the housing and which rocks in said second cylinder with a second key thereof engaged in said second slot; and a cover which closes the opening of said first cylinder of the housing;

wherein the first rotor and the second rotor are rocked by said rotary shaft.

2. A compressor comprising:

a compression element and an electric element housed in a hermetically sealed vessel; wherein the hermetically sealed vessel is divided into an oil reservoir chamber and a hermetically sealed chamber by a partitioning member;

oil pumps for two systems mounted on one end of a rotary shaft;

said oil pumps being arranged so that oil is sucked into one of the oil pumps from said oil reservoir chamber to feed the oil to said compression element mounted on the other end of said rotary shaft; and the oil is sucked into the other oil pump from said hermetically sealed chamber to feed it to said oil reservoir chamber; and wherein a single pump constitutes said pumps for two systems and comprises:

a housing having a first slot, a first inlet, a first outlet, a second slot, a second inlet, and a second outlet;

a first rotor housed in a first cylinder of the housing and which rocks in the first cylinder with a first key thereof engaged in said first slot, and which closes the opening of a second cylinder of the housing;

a second rotor housed in the second cylinder of the housing and which rocks in said second cylinder with a second key thereof engaged in said second slot; and a cover which closes the opening of said first cylinder of the housing;

wherein the first rotor and the second rotor are rocked by said rotary shaft.

3. A compressor according to claim 2, wherein the oil feeding capability of the oil pump for supplying oil from the hermetically sealed chamber to the oil reservoir chamber is equivalent to, or more than, that for supplying oil from the oil reservoir chamber to the compression element.

4. A compressor according to claim 2, wherein the compressor is a low internal pressure type compressor, and further comprising an oil feeding passage for feeding oil from the hermetically sealed chamber to the oil pump, which passage opens below a gas inlet of said compression element.

5. A compressor according to claim 4, wherein the oil feeding capability of the oil pump for supplying oil from the hermetically sealed chamber to the oil reservoir chamber is equivalent to, or more than that, for supplying oil from the oil reservoir chamber to the compression element.

6. A compressor according to claim 2, wherein the compressor is a high internal pressure type compressor, and further comprising an oil feeding passage for feeding oil from the hermetically sealed chamber to the oil pump, which passage opens below a gas inlet of said compression element.

7. A compressor according to claim 6, wherein the oil feeding capability of the oil pump for supplying oil from the hermetically sealed chamber to the oil reservoir chamber is equivalent to, or more than that, for supplying oil from the oil reservoir chamber to the compression element.

* * * * *